US010245801B2

(12) United States Patent
Yang

(10) Patent No.: US 10,245,801 B2
(45) Date of Patent: Apr. 2, 2019

(54) BRIQUETTING MACHINE AND BRIQUETTING METHOD FOR LOOSE METAL SCRAPS

(71) Applicant: Yaojin Yang, Jiangsu (CN)

(72) Inventor: Qijun Yang, Jiangsu (CN)

(73) Assignee: Yaojin Yang, Wuxi, Jiangsu Province (CN)

( * ) Notice: Subject to any disclaimer, the term of this patent is extended or adjusted under 35 U.S.C. 154(b) by 150 days.

(21) Appl. No.: 14/787,305

(22) PCT Filed: Apr. 22, 2014

(86) PCT No.: PCT/CN2014/075912
§ 371 (c)(1),
(2) Date: Oct. 27, 2015

(87) PCT Pub. No.: WO2014/173283
PCT Pub. Date: Oct. 30, 2014

(65) Prior Publication Data

US 2016/0101584 A1 Apr. 14, 2016

(30) Foreign Application Priority Data

Apr. 27, 2013 (CN) ..... 2013 1 0150630

(51) Int. Cl.
*B30B 9/30* (2006.01)
*B30B 9/32* (2006.01)
(Continued)

(52) U.S. Cl.
CPC ..... *B30B 9/327* (2013.01); *B30B 7/04* (2013.01); *B30B 9/301* (2013.01); *B30B 9/3078* (2013.01); *B30B 11/00* (2013.01)

(58) Field of Classification Search
CPC ..... B30B 9/327; B30B 9/32; B30B 9/321; B30B 7/04; B30B 9/3014; B30B 9/3078;
(Continued)

(56) References Cited

U.S. PATENT DOCUMENTS 3,141,401 A * 7/1964 Lindemann ..... B30B 9/326 100/215
3,908,538 A * 9/1975 Boyd ..... B30B 9/3078 100/137

(Continued)

*Primary Examiner* — Jimmy T Nguyen
(74) *Attorney, Agent, or Firm* — Jeanette Meng Nakagawa PhD

(57) ABSTRACT

A briquetting machine for loose metal scraps comprises a pre-extrusion part, a re-extrusion part and a final pressing part. On the upper portion of a pre-extrusion cavity (14) of the pre-extrusion part, a pre-extrusion releasing area (15) is formed near to one side of a re-extrusion cavity (24). At the front end of a re-extrusion plunger (23) of the re-extrusion part, a lateral gap (28) is formed near to one side of the pre-extrusion cavity. The cross section of the lateral gap is a right-angled trapezoid and the lateral gap is provided with a lateral slope (29). A briquetting method for loose metal scrapes is disclosed. By way of pre-extrusion and step-by-step feeding and triggering resetting loading, not only is a certain pre-pressing effect guaranteed while the loose metal scraps are processed in each feeding and pre-pressing step, but also the stress can be transferred and released timely under the over-pressure condition, which avoids the formation of dense metal block under the over-pressure condition. Therefore a continuous, automatic and safe pressing operation is assured.

8 Claims, 4 Drawing Sheets

(51) Int. Cl.
*B30B 7/04* (2006.01)
*B30B 11/00* (2006.01)

(58) Field of Classification Search
CPC ..... B30B 9/301; B30B 11/007; B30B 11/00; B30B 15/08; B30B 9/28; B22F 8/00
USPC ..... 100/232, 906, 215, 218, 240, 245, 295
See application file for complete search history.

(56) References Cited

U.S. PATENT DOCUMENTS 4,557,190 A * 12/1985 Vezzani ..... B30B 9/3078 100/215
4,601,238 A * 7/1986 Davis, Jr. ..... B30B 9/32 100/137
5,203,261 A * 4/1993 Davis ..... B30B 9/3078 100/215
5,987,858 A * 11/1999 Long ..... B30B 9/301 100/190
7,421,946 B1 * 9/2008 Pontus ..... B30B 9/301 100/215
7,448,318 B1 * 11/2008 Ralicki ..... B02C 19/22 100/116
7,461,496 B2 * 12/2008 Hasselbach ..... B65B 1/24 100/188 R
2007/0084359 A1 * 4/2007 Schomisch ..... B30B 9/3096 100/245
2010/0064908 A1 * 3/2010 Curles ..... B30B 9/3078 100/209
2012/0042793 A1 * 2/2012 Murray ..... B30B 7/04 100/39

* cited by examiner

BRIQUETTING MACHINE AND BRIQUETTING METHOD FOR LOOSE METAL SCRAPS

TECHNICAL FIELD

The invention relates to a loose metal scrap briquetting machine, belonging to the scrap metal recycling technology field.

TECHNICAL BACKGROUND

The scrap briquetting machine is used to extrude various loose-density ferrous or non-ferrous metal blocks, cutting curls, scraps, etc. into the dense-density cakes under the action of the hydraulic punch so as to facilitate transportation and storage. Finally, these scrap cakes are put into the metal smelting furnace and recycled after smelting. The Chinese Patents "CN201010156906.4—Horizontal Scrap Cake Machine" and "CN 201010277629.2—Scrap Metal Briquetting Machine" applied for by the applicant discloses their structures and operating principles: the transverse feeding primary pre-pressing, longitudinal secondary pre-pressing and vertical final pressing of scraps realize the three-way extrusion of metal scraps; due to the reasonable compression mode and large compressive force, the very large compression ratio and high compression efficiency can be achieved.

In practice, the composition of the materials to be processed is complicated. For the carbon-containing ferrous metals (such as carbon steel, etc.), they are relatively hard and brittle. For the existing briquetting machine, a relatively close fit is generally designed at the junction among the pre-extruding cavity, secondary extruding cavity and final pressing cavity and between the punch and cavity wall. This type of small gaps can be taken as the shearing surface during the feeding of the extruding punch so as to shear off relatively brittle ferrous metal curls, shavings, etc. But in the recycling technology of electric wires, cables and other wire materials, granular copper particles can be obtained, which are visually called "copper rice" in engineering. This type of granular metal materials has very high density, and copper itself is very soft. At the junction among the small gaps, when all extruding punches move forwards or return to the original position, the residual materials during each time of feeding often receive the complex extrusion force in many directions so as to very easily and directly form the dense copper cakes under the conditions of temperature and pressure. During the feeding of the extruding punch in the next step, the extruding punch no longer feeds the materials by pushing but shears or rolls the materials into copper cakes, which cause the sharp increase of the extrusion force in various directions. In practical production, some virtual travels generally need to be carried out after several times of extrusion so as to process the internal blockage. These extra processing procedures not only greatly reduce the work efficiency but also affect the continuity of operation. During the serious soft metal blockage, the equipment may be damaged, the "cylinder burst" accident may occur, and serious potential safety hazards may occur.

DISCLOSURE OF THE INVENTION

Technical Problems

According to the characteristics of the sharp increase of hydraulic pressure, the existence of potential safety hazards, etc. caused due to the easy formation of soft metal cakes during the briquetting production of the existing loose metal scraps, the applicant provides a loose metal scrap briquetting machine with reasonable structure and briquetting method so as to continuously and safely carry out the briquetting operation of loose metal scraps.

Technical Solutions

Technical solution applied in the present invention is as follows:

A loose metal scrap briquetting machine comprises a pre-extruding part, a re-extruding part and a final pressing part. A pre-extruding release area is arranged at one side close to the re-extruding cavity at the upper part of a pre-extruding cavity of the pre-extruding part, a side gap is arranged at one side close to the pre-extruding cavity at the front end of a re-extruding punch of the re-extruding part, and the section of the side gap is a right angled trapezoid and provided with a side slope.

In order to further improve the above technical solution, the baffle plate divides the hopper into the adjacent material staging area and the pre-extruding release area.

The upper part of the re-extruding cavity is provided with the re-extruding release area. The top gap with the top slope is arranged at the front top end of the re-extruding punch of the re-extruding part.

The front part of the pre-extruding cavity is provided with the travel switch, which can be adjusted back and forth.

A briquetting method of the loose metal scrap briquetting machine includes the following steps: Step 1: the pre-extruding punch pushes some loose metal scraps in the pre-extruding cavity into the re-extruding cavity according to the set procedures, and some redundant materials overflow into the pre-extruding release area. Step 2: The re-extruding punch pushes the materials in the re-extruding cavity into a final pressing cavity, and some redundant materials overflow into the pre-extruding cavity. Step 3: The final pressing punch pre-compresses the materials in the final pressing cavity, and the final pressing punch and re-extruding punch return to the original position. When the specified requirements of final pressing are met, the final pressing punch carries out the briquetting and unloading of the materials in the final pressing cavity. Step 4: Before the pre-extruding punch triggers the travel switch, Steps 1, 2 and 3 are circulated. Step 5: After the pre-extruding punch triggers the travel switch, the pre-extruding punch fully returns to the original position and the materials in the material staging area loads the materials for the pre-extruding cavity; then return to Step 1.

Beneficial Effects

Beneficial effects of the present invention are as follows:

According to the material characteristics of loose metal scraps, the invention abandons the inherent thinking of the traditional briquetting machine using small gaps to cut materials and adopts the method of arranging the release area at the junction, arranging the gap with the slope at the punch front end, pre-extruding the feeding step by step and triggering the reset loading to ensure a certain pre-pressing effects and timely transfer and release the stress in the case of overpressure at each step of feeding and pre-pressing of loose metal scraps, which avoids forming the dense metal cakes in the case of overpressure so as to ensure the continuous, automatic and reliable briquetting operation of the equipment without pause and manual intervention, efficiently improve the reliability and security of the equipment and have remarkable economic benefits.

BRIEF DESCRIPTION OF FIGURES

Description of Figures

Figure 1:
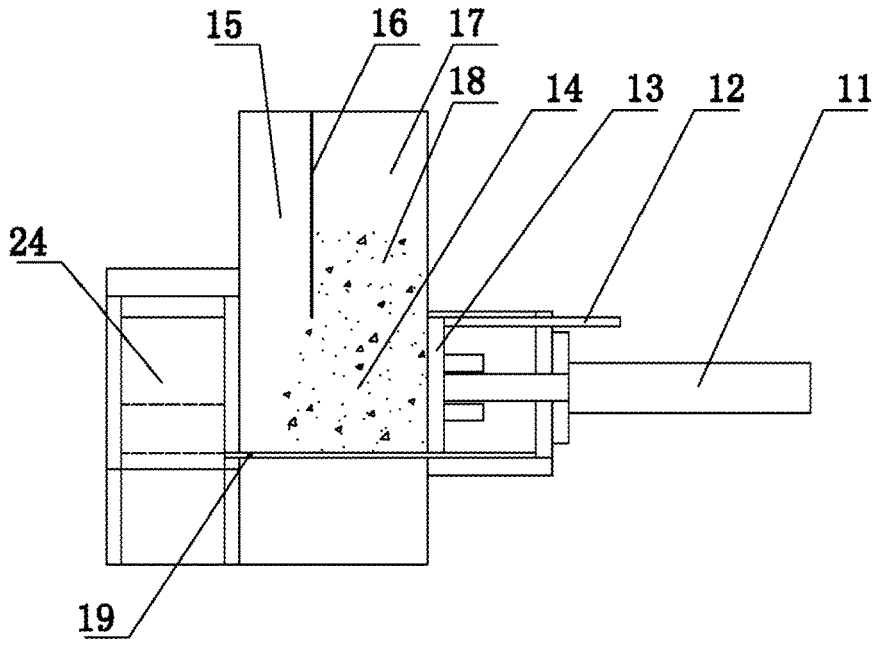

FIG. 1 is the loading step state diagram of the invention.

Figure 2:
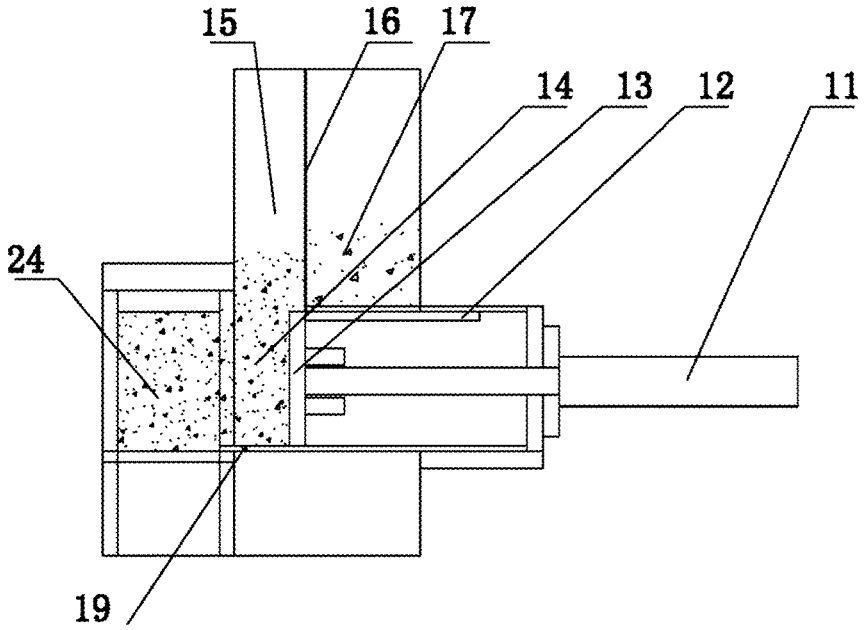

FIG. 2 is the pre-pressing step state diagram of the invention.

Figure 3:
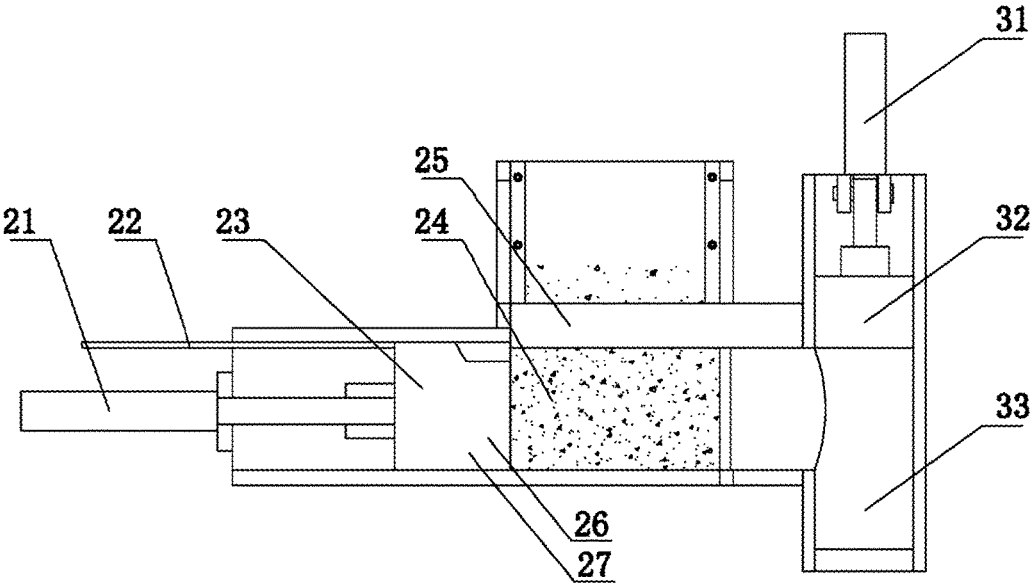

FIG. 3 is the left view of FIG. 2.

Figure 4:
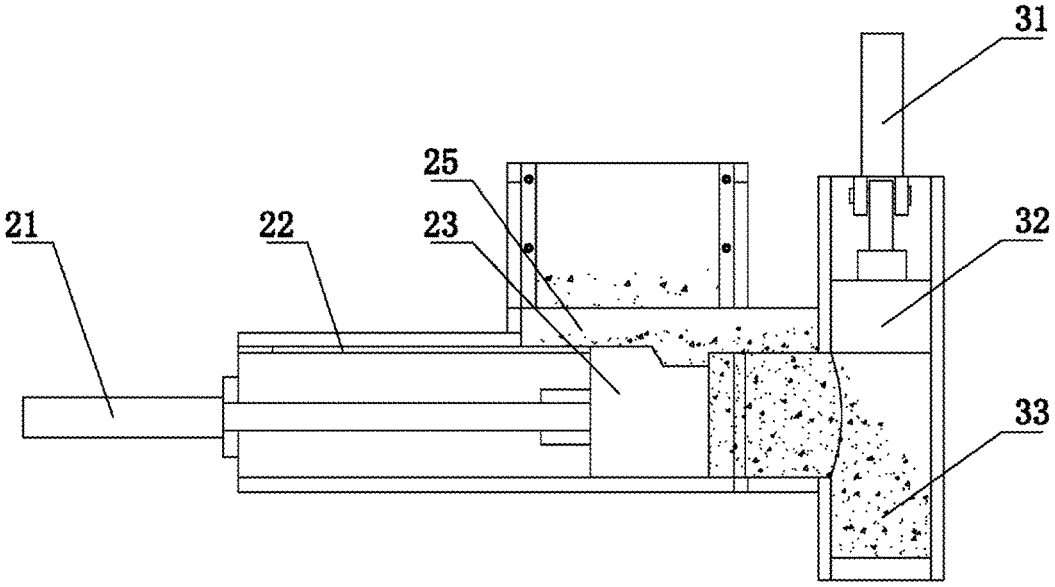

FIG. 4 is the re-extruding step state diagram of the invention.

Figure 5:
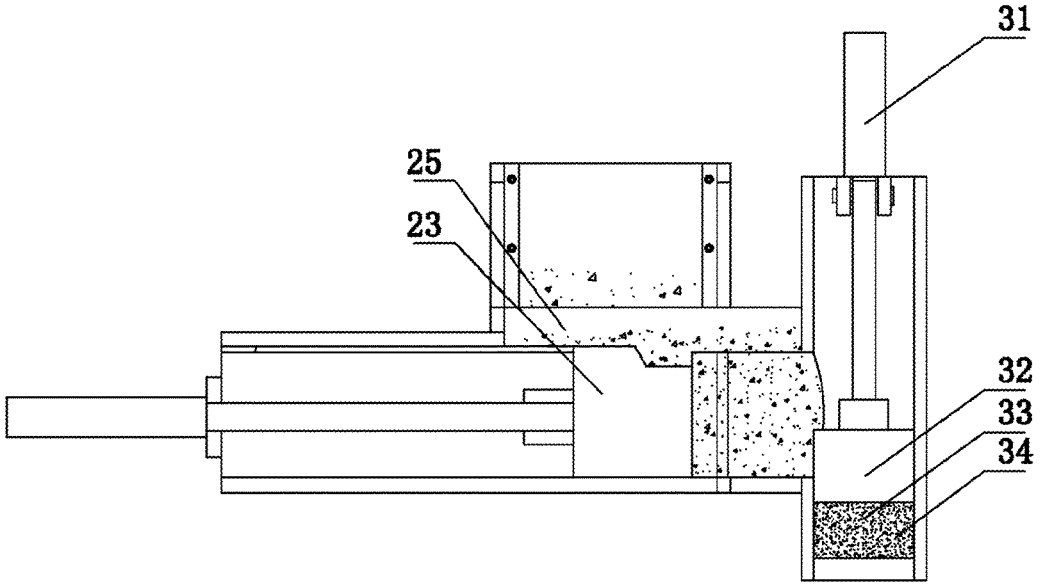

FIG. 5 is the final pressing step state diagram of the invention.

Figure 6:
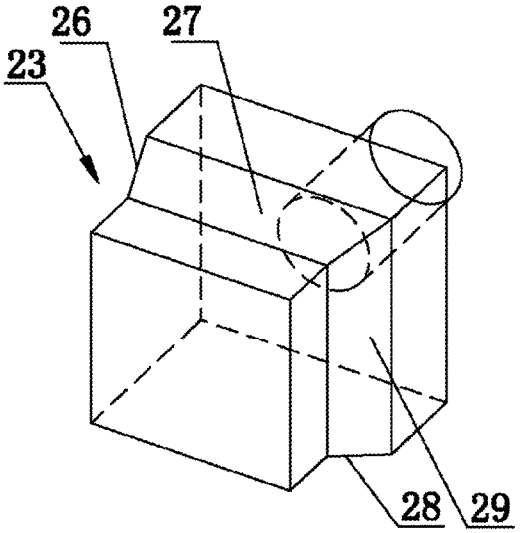

FIG. 6 is the re-extruding punch space diagram of the invention.

Figure 7:
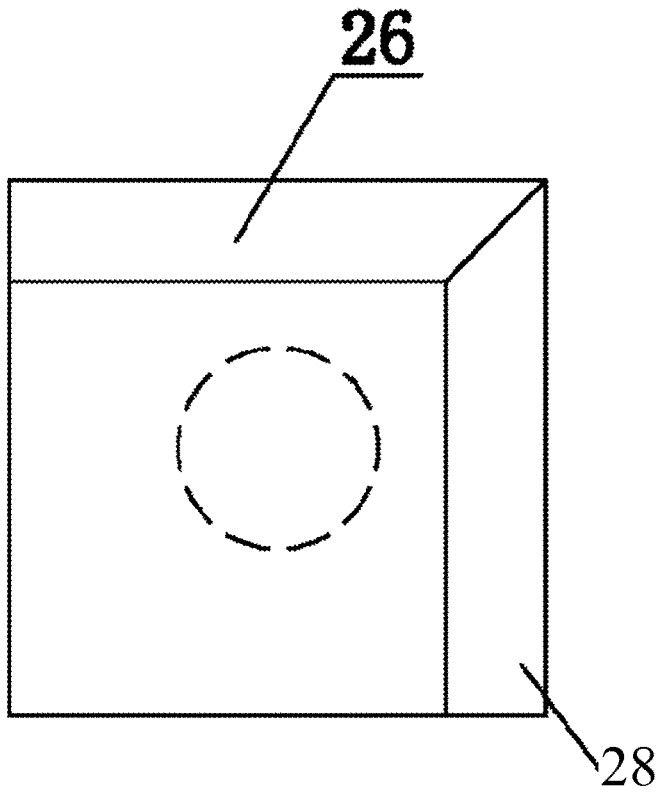

FIG. 7 is the front view of FIG. 6.

Figure 8:
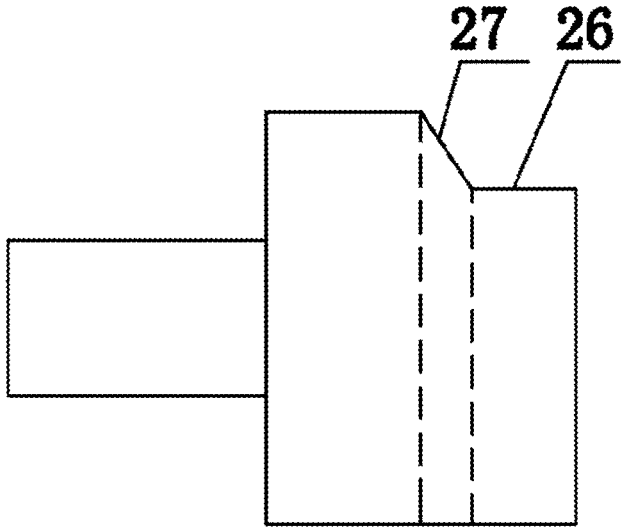

FIG. 8 is the left view of FIG. 6.

In the figures, 11: pre-extruding hydraulic cylinder, 12: pre-extruding top plate, 13: pre-extruding punch, 14: pre-extruding cavity, 15: pre-extruding release area, 16: baffle plate, 17: material staging area, 18: loose metal scrap, 19: travel switch, 21: re-extruding hydraulic cylinder, 22: re-extruding top plate, 23: re-extruding punch, 24: re-extruding cavity, 25: re-extruding release area, 26: top gap, 27: top slope, 28: side gap, 29: side slope, 31: final pressing extruding cylinder, 32: final pressing punch, 33: final pressing cavity, 34: metal cake.

BEST MODE OF THE INVENTION

In combination of the descriptions in the figures, the best mode of carrying out the present invention is described as follows.

Through a large number of researches and practices, the applicant finds that the high-density and soft loose metal scraps similar to "copper rice" cannot be extruded densely during briquetting and a larger release space needs to be provided to hold the expansion after stress. According to the above principles, the invention is improved in the aspects of structure, control, etc. of the original briquetting machine.

As shown in FIG. 1 and FIG. 2, the invention increases an upright-arranged baffle plate 16 in the hopper at the upper part of the pre-extruding cavity 14 to divide the hopper into the adjacent material staging area 17 and the pre-extruding release area 15 which is close to one side of the re-extruding cavity 24. The bottom surface of the front part of the pre-extruding cavity 14 is provided with the travel switch 19 which can be adjusted back and forth.

During actual operation, the loose metal scrap 18 is input from the opening of the material staging area 17 and enters the pre-extruding cavity 14. When the equipment carries out the pre-extrusion, the pre-extruding hydraulic cylinder 11 drives the pre-extruding punch 13 to move forwards so as to push the materials in the pre-extruding cavity 14 into the re-extruding cavity 24, and the pre-extruding top plate 12 gradually closes the bottom of the material staging area 17 so as to prevent the materials in the material staging area 17 from falling into the rear space of the pre-extruding punch 13 to damage the equipment. A shown in FIG. 2, when the re-extruding cavity 24 is filled with materials, the materials after compression at the front end of the pre-extruding punch 13 overflow and fill the pre-extruding release area 15 so as to avoid forming metal cakes due to the excessive extrusion in the limited space.

For the existing briquetting machine equipment, basically the pre-extruding punch 13 immediately returns to the original position after the one-time thorough pre-extrusion so as to carry out the next-time feeding, namely that each time of pre-extrusion coordinates with the one-time re-extrusion and final pressure. In practice, it is found that if this pre-extrusion mode is also used for loose metal scraps, the materials in the material staging area 17 at the upper part are supplemented rapidly after the pre-extruding punch 13 returns to the original position, which results in that the materials in the pre-extruding cavity 14 are more and more and gradually pressurized so as to form the dense metal cakes. Therefore, in the invention, the front part of the pre-extruding cavity 14 is provided with the travel switch 19 which can be adjusted back and forth. In practice, the commissioning is first carried out according to the materials to be extruded so as to determine the cylinder stretching time of the pre-extruding hydraulic cylinder 11 and the front and back positions of the travel switch 19. Before the pre-extruding punch 13 comes into contact with the travel switch 19, it is stipulated that the hydraulic cylinder can only be gradually pushed into the pre-extruding punch 13 according to the predetermined cylinder stretching time and kept at the current position, and then the briquetting machine carries out the re-extruding and final pressing actions. The pre-extruding hydraulic cylinder 11 can be shrunk only after the pre-extruding punch 13 triggers the travel switch 19, which can make the pre-extruding punch 13 fully return to the original position so as to realize the next-time loading of the pre-extruding cavity 14; that is to say, according to the difference of the materials to be extruded, the one-time loading of the pre-extruding cavity 14 can meet the filling requirements of multi-time re-extruding and final pressing actions step by step. Certainly, the above method can carry out the cylinder stretching control through the time, travel distance or pressure feedback, but the method of time control is relatively simple and effective. The method of feeding step by step and triggering reset can ensure that there are a moderate number of proper-density materials in the re-extruding cavity 24 during each time of re-extruding operation. When the re-extruding punch 23 returns to the original position after the re-extruding and final pressing actions are completed, the materials overflowing in the pre-extruding release area 15 at the previous step also fall into the re-extruding cavity 24 so as to coordinate with the feeding action of the pre-extruding punch 13 at the next step to fill the re-extruding cavity 24. In this way, the materials overflowing in the pre-extruding release area 15 can also be consumed timely.

In Sum, through arranging the pre-extruding release area 15 at the upper part of the junction between the pre-extruding cavity and the re-extruding cavity and adopting the method of carrying out the feeding step by step and triggering the reset loading by the pre-extruding punch 13, the stress of loose metal scraps can be released timely under the complex stress condition, and simultaneously it is ensured that loose metal scraps are fed into the re-extruding cavity at a proper density and quantity so as to avoid forming the metal cakes in the case of overpressure.

As shown in FIG. 3 and FIG. 4, in the invention, the upper part of the re-extruding cavity is provided with the re-extruding release area 25, and the top surface of the re-extruding punch 23 is provided with the re-extruding top plate 22 to divide the re-extruding release area 25 and the re-extruding cavity 24 during propulsion. As shown in FIG. 6 to FIG. 8, in the invention, the front end top of the re-extruding punch 23 is provided with the top gap 26, one side close to the pre-extruding cavity 14 is provided with the side gap 28, the section of the side gap is a right trapezoid, the top gap 26 is provided with the top slope 27, and the side gap 28 is provided with the side slope 29. After the gap is arranged, the actual pushing area of the front part of the re-extruding punch is about ½ to ⅔ of the original punch area.

In actual operation, the pre-extruding punch 13 feed the materials into the re-extruding cavity 24. As shown in FIG. 4, the re-extruding hydraulic cylinder 21 carries out the cylinder stretching action to feed forwards the re-extruding punch, which not only recompresses the materials in the re-extruding cavity 24 but also feeds the materials into the final pressing cavity 33. In this process, some materials between the top gap 26 and the side gap 28 of the re-extruding punch 23 are not extruded largely but guided and transferred by the top slope 27 to the re-extruding release area 25 at the top or guided and transferred by the side slope 29 to the pre-extruding cavity 14; the upper part of the pre-extruding cavity 14 is also provided with the pre-extruding release area 15 which can overflow and hold these materials so as to avoid producing the extrusion force with the original materials in the pre-extruding cavity 14. The punch structure provided with the gap not only is provided with the reasonable release space but also makes the materials have the transferable space after receiving overpressure so as to timely relieve pressure, which prevents the existing briquetting machine from causing the shearing at the small gap of the junction. The pressure from the top and one side can make the bottom and the other side of the re-extruding punch 23 tightly close to the cavity wall of the re-extruding cavity so as to prevent the scraps or particles from being sandwiched during propulsion to improve the equipment reliability. When the re-extruding punch 23 returns to the original position, the materials in the re-extruding release area 25 and the pre-extruding cavity 14 are re-supplemented to the re-extruding cavity 24.

As shown in FIG. 5, the final pressing extruding cylinder 31 drives the final pressing punch 32 to fully extrude the materials in the final pressing cavity 33 so as to obtain the dense metal cake 34.

It needs to be explained that the upper part of the re-extruding cavity 24 is provided with the re-extruding release area 25 and simultaneously the top surface of the re-extruding punch 23 is provided with the top gap 26 which can be the optimized structure aimed at some special soft metal scraps. The briquetting machine for processing the conventional loose metal scraps is provided with the pre-extruding release area 15 and the side gap 28 is arranged at one side close to the pre-extruding cavity 14 of the re-extruding punch so as to successfully implement the pressure relief of scraps and ensure the continuously normal operation of the equipment.

The above description is an exemplary implementation of the present invention, and is not in anyway limiting. The scope of the present invention is defined in its claims. The invention can be modified in any form without violating its principle of operation.

What is claimed is:

1. A briquetting apparatus comprising:

a pre-extruding punch advancing in a first pathway along a bottom section of a hopper pushing loose metal scraps towards a first entrance leading to an adjacent re-extruding cavity, wherein the hopper further comprises a material staging area, a pre-extruding release area, and an upright arranged baffle plate for dividing the material stage area and the pre-extruding release area to accommodate overflow of the loose metal scraps into the pre-extruding release area as the pre-extruding punch advances towards the first entrance of the re-extruding cavity;

a re-extruding punch advancing in a second pathway perpendicular to the pre-extruding punch, compressing and pushing the loose metal scraps from the re-extruding cavity towards a second entrance leading to an adjacent final extruding cavity, wherein a front end of the re-extruding punch comprises at least one indented gap to direct overflow of the loose metal scraps in the re-extruding cavity into the pre-extruding release area and into a re-extruding release area around the second entrance; and a final-extruding punch advancing in a third pathway perpendicular to both the pre- and re-extruding punches, further compressing the loose metal scraps in the final extruding cavity to form a metal cake.

2. The briquetting apparatus of claim 1, wherein the baffle plate situates above the first pathway of the pre-extruding punch at a preset distance away from the first entrance.

3. The briquetting apparatus of claim 1, further comprises a pre-extruding top plate situated immediately above the pre-extruding punch, and advances in synchrony with the pre-extruding punch along the first pathway to prevent loose metal scraps in the material staging area from falling into the first pathway.

4. The briquetting apparatus of claim 1, wherein the first pathway further comprises a travel switch situated at an adjustable distance away from the first entrance, and when the pre-extruding punch comes into contact with the travel switch, the pre-extruding punch stops advancing towards the first entrance and retracts along the first pathway to a starting position.

5. The briquetting apparatus of claim 1, wherein the re-extruding release area is located immediately above the re-extruding cavity to accommodate overflow of loose scrap metal in the re-extruding cavity as the re-extruding punch advances towards the second entrance of the final-extruding cavity.

6. The briquetting apparatus of claim 1, wherein the re-extruding punch is indented to form a top gap on a surface adjacent to the re-extruding release area, which directs overflow of loose scrap metal in the re-extruding cavity into the re-extruding release area.

7. The briquetting apparatus of claim 1, wherein the re-extruding punch is indented to form a side gap on a surface adjacent to the pre-extruding release area, which directs overflow of loose scrap metal in the re-extruding cavity into the pre-extruding release area along the first entrance.

8. The briquetting apparatus of claim 1, wherein the pre-extruding punch, the re-extruding punch and the final-extruding punch are advanced and retracted via hydraulic cylinders respectively housed along the first, the second, and the third pathways.

* * * * *